United States Patent [19]

Holmsten

[11] Patent Number: 4,514,992

[45] Date of Patent: May 7, 1985

[54] REFRIGERATION SYSTEM FOR ICE RINKS UTILIZING PRESSURE CONTROL/METERING VALVE

[76] Inventor: Richard B. Holmsten, 2127 Dudley Ave., St. Paul, Minn. 55108

[21] Appl. No.: 591,220

[22] Filed: Mar. 19, 1984

[51] Int. Cl.[3] ..... A63C 19/10

[52] U.S. Cl. ..... 62/235; 62/174

[58] Field of Search ..... 62/509, 235, 218, 174, 62/511

[56] References Cited

U.S. PATENT DOCUMENTS 3,831,394 8/1974 Holmsten ..... 62/509 X

*Primary Examiner*—William E. Wayner
*Assistant Examiner*—John M. Sollecito
*Attorney, Agent, or Firm*—Orrin M. Haugen; Thomas J. Nikolai; Douglas L. Tschida

[57] ABSTRACT

A system for providing a refrigerant to an ice rink, the system including a compressor means for compressing a refrigerant, means for delivering the compressed refrigerant to a low pressure receiver vessel, and means for passing refrigerant condensate from said low pressure vessel to a pair of pumper drum vessels. The rink is provided with a plurality of refrigerant transmitting conduits extending from one end thereof to the other, and with a high pressure header extending across one end of the rink and a low pressure header extending across the opposed end of the rink. The high pressure header is provided with a balance header which couples the opposite free ends of this header element together, and an intermediate line or conduit is also provided which couples the central or mid-portions of the high pressure header and the balance header together.

3 Claims, 2 Drawing Figures

REFRIGERATION SYSTEM FOR ICE RINKS UTILIZING PRESSURE CONTROL/METERING VALVE

BACKGROUND OF THE INVENTION

The present invention relates generally to an improved fluid flow system for providing a medium for exchange or for the extracting of thermal energy in skating rinks. The system of the present invention is an improvement over that system disclosed and claimed in U.S. Pat. No. 3,466,892, dated Sept. 16, 1969 and U.S. Pat. No. 3,831,394, dated Aug. 27, 1974.

A fundamental feature of the system is to provide a means for the uniform circulation of liquid refrigerant to the large area being refrigerated, wherein substantially uniform pressures and corresponding equalization of pressure differentials are achieved across the distribution system and in the areas being treated. Uniformity in ice in the rink is achieved in this fashion. In the refrigeration system utilized in the combination of the present invention, the refrigeration system utilizes a compressor means for compressing a refrigerant, means for delivering the compressed refrigerant to a low pressure receiver vessel, and means for passing refrigerant condensate from a low pressure vessel to a pair of pumper drum vessels. Refrigerant is delivered from the pumper drum vessels to the ice rink per se through the distribution system of U.S. Pat. No. 3,831,394, with the present improvement providing a means for controllably providing chilled refrigerant from the pumper drums to the ice rink.

In the low pressure receiver, a portion of the liquid refrigerant undergoes a phase transformation to deliver a refrigerating effect to the refrigeration area by means of the propulsion achieved by fluids in the liquid state under high pressure and substantially directly from the compressor device. This technique eliminates the necessity of transmission or circulation of liquid refrigerant at extremely low temperatures, and permits operation at a reasonably constant temperature which is in the range of between about 15°-18° F. This temperature is one which results in an ice surface which is deemed ideal for ice hockey or figure skating, and this system accomplishes the result with unusually high efficiency. Since refrigerant delivered from the compressor is in the form of high pressure-high temperature gas, and is condensed in the conventional condenser column, whereupon the gaseous refrigerant is converted to high pressure-high temperature liquid. In order to more carefully control the temperature of the chilled refrigerant in the pumper drums, an expansion orifice is employed adjacent the upper portion of the pumper drum so as to accomplish a liquid-to-gas phase conversion and resultant cooling.

In order to equalize the flow of chilled low pressure-low temperature refrigerant through the system, and in order to eliminate wide pressure differentials, a balance header is provided which extends between opposed ends of the high pressure header at one end of the rink. An intermediate line is also provided which couples the central or mid-portions of the high pressure header and the balance header together. In this fashion, uniformity of ice conditions without presence of warm areas of soft or wet ice is provided. The intermittent pressurized system coupled to the pumper drums provides a distribution system for low pressure-low temperature refrigerant which achieves a high degree of uniformity of ice conditions, particularly when coupled with the balance header of U.S. Pat. No. 3,831,394.

SUMMARY OF THE INVENTION

Briefly, in accordance with the present invention, in the refrigeration portion of the combination the refrigerant material is passed through a compressor wherein it is transformed in phase so that upon passing through a condenser, the refrigerant remains at high temperature and high pressure, while converted substantially entirely to the liquid state. This material is ultimately passed through a pressure reducing or demand valve and on to a low pressure receiver wherein a portion of the liquid undergoes a phase transformation to the gaseous state to control the temperature of the material therein at a modestly low temperature level. The liquid remaining in this receiver is permitted to flow or drain to one of a pair of drums, and when either of the drums becomes substantially entirely filled, the filled drum is coupled by means of suitable valving, substantially directly to the output of the compressor-condenser combination, which output is at a relatively higher pressure, and this fluid under the influence of this higher pressure is utilized to force the chilled refrigerant from the pumper drum out into the distribution system and thus through the rink area. To accomplish this, the fluid is forced under pressure into the pressure header and thus through the distribution system, and accordingly into the refrigeration area. In order to monitor the temperature level of the fluid utilized to force the chilled refrigerant from the pumper drum, a fixed orifice is disposed within the conduit adjacent the upper portion of the pumper drum to provide pressure reduction and an ultimate expansion zone. This pressure reduction permits conversion of the high pressure-high temperature refrigerant to a somewhat lower pressure-lower temperature refrigerant primarily in the gaseous phase. After passing through the refrigeration area, the fluid, in both liquid and gaseous phases, is returned to the low pressure receiver. The evaporant present in the low pressure receiver is transmitted on a continuous basis to the compressor or compressors for continuing the cycle.

In certain operating conditions, particularly under those conditions wherein the demand may vary, the temperature control for the refrigerant delivered from the pumper drum is important. In particular, when the demands on the system are relatively low or modest, fluid entering the pumper drum may tend to increase the temperature of the liquid refrigerant contained therein, thereby adversely affecting the quality of the ice. Also, in order to reduce or minimize the piping requirements, the same conduit utilized to provide the pressurized fluid to the pumper drum performs an alternate function as well. Specifically, while the pumper drum is being filled, the line from the top of the pumper drum functions as a vent, and communicates directly with the upper portion of the low pressure receiver. The fixed orifice which is employed is utilized to accommodate a unique balance for the system, with the unique balance providing appropriate expansion of the refrigerant providing the driving force, as well as an adequate vent for the gaseous refrigerant to return to the upper portion of the pumper drum.

In the distribution portion of the combination, the fluid transmission comprises a high pressure header which extends across one end of an ice rink, a low pressure header extending across the opposite end of the rink, and rink chilling conduit means extending therebetween to define an ice rink area. A first supply conduit is coupled to one end of the high pressure header, and a second supply conduit means is coupled to the opposed end of the high pressure header, with each supply conduit means being in direct communication with a separate pumper drum vessel. A balance header couples the opposed ends of the high pressure header to each other, and an intermediate line is also provided which couples the central or mid-portions of the high pressure header to the balance header. A return conduit means is coupled to the low pressure header substantially at the mid-point thereof, to deliver refrigerant from the low pressure header to the low pressure receiver.

Therefore, it is a primary object of the present invention to provide an improved system for the transmission or circulation of refrigerant under carefully controlled temperature conditions through an ice rink refrigeration zone, the transmission utilizing the circulation of chilled refrigerant fluid in the liquid state directly into the header zone of an area being refrigerated.

It is yet a further object of the present invention to provide an improved system for the circulation or transmission of fluid refrigerant in liquid phase, the refrigerant being propelled through the system from a liquid refrigerant pumping drum coupled intermittently to the output of the refrigerator compressor and into a high pressure header utilizing a balanced header to achieve uniformity, and wherein the refrigerant used to propel fluid through the system undergoes an expansion immediately before entering the pumping drum so as to assist in controlling the pressure-temperature conditions thereof.

It is yet a further object of the present invention to provide an improved system for circulating refrigerant in the liquid state through an ice rink area, with the refrigerant being delivered through the system substantially uniformly and at a substantially constant temperature level across the entire rink area.

Other and further objects of the present invention will become apparent to those skilled in the art upon a study of the following specification, appended claims, and accompanying drawings.

DESCRIPTION OF THE PREFERRED EMBODIMENT

Figure 1:
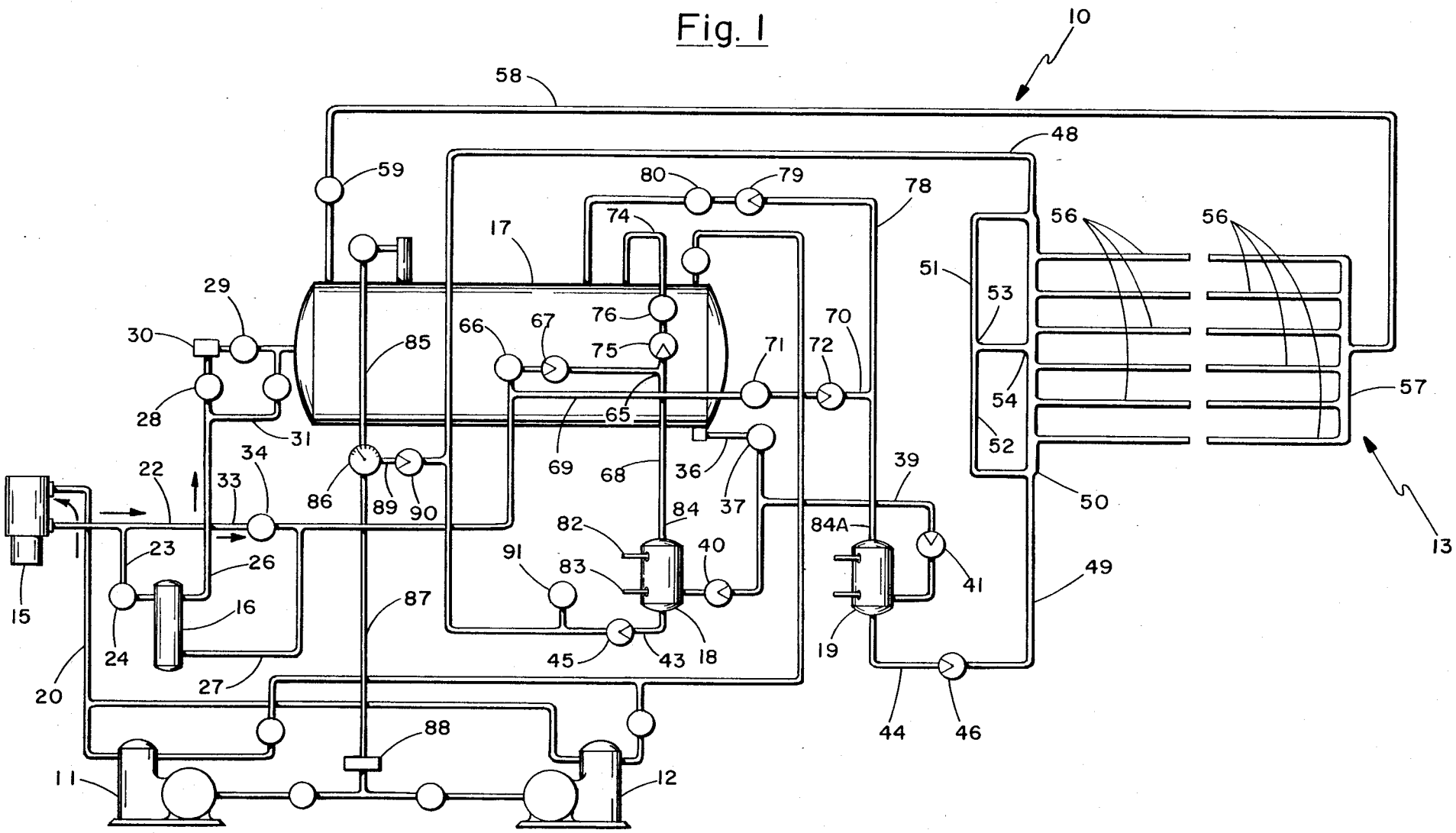
FIG. 1 is a schematic diagram of one typical installation employing the improved system aspects of the present invention.

In accordance with the preferred modification of the present invention, the refrigeration system of the combination of the present invention is generally designated 10 and includes a pair of compressors 11 and 12, these compressors being coupled in parallel relationship for treating the refrigerant which is being delivered into the area or zone being refrigerated, such as the skating rink shown at 13. The system includes certain other major components including a condenser 15, a liquid storage vessel 16, a low pressure receiver chamber or vessel 17, and a pair of pumper drums 18 and 19. The individual components are coupled together by means of suitable conduits, as indicated, and as more fully explained hereinafter.

Referring to the system, the compressors 11 and 12 deliver a pre-selected refrigerant, such as, for example, Freon-22 to a main conduit 20, the output of the compressors 11 and 12 being coupled in parallel fluid relationship. These compressors are driven by any suitable source of power, such as, for example, an electrical power source or an internal combustion engine. Conduit 20 extends to and communicates with the condenser 15 which is operated in a conventional fashion. The output of the condenser 15 is transmitted by means of the conduit segment 22 and the conduit 23 through a controlled metering valve 24 and thence into the liquid storage vessel 16. Liquid storage vessel 16 is provided with a pair of outlet conduits, these being shown at 26 and 27. Conduit 26 is provided with a pair of control valves, for example gate valves 28 and 29, along with a pressure reducing or demand flow control vave 30. A bypass is provided, as indicated, at 31 to accommodate the system when the valve 30 is not being utilized, valves 28 and 29 being utilized to isolate valve 30 from the system. Outlet 27 extends from the liquid storage vessel 16 to a juncture point with the liquid storage vessel bypass line 33, the flow in line 33 being controlled by valve 34. Line 27 extends to a second juncture point or fluid divider point as at 65 where the fluid is driven or carried for transmission directly into one of the drums, such as drum 18, for a purpose as will be more fully explained hereinafter or for transmission to the vessel 17.

Following its transmission into the low pressure receiver 17, a portion of the liquid transmitted is transformed into the vapor phase, and the remaining material remains in the liquid phase. The liquid is removed from the low pressure receiver 17 by gravity through conduit 36, which is provided with a servicing valve 37, and ultimately into the pumper drum 18. Of course, a suitable conduit 39 may be coupled to conduit 36 in order to carry refrigerant fluid in liquid state on an alternating cycle basis to the second pumper drum 19. Suitable check valves such as are shown at 40 and 41 are utilized to isolate the pumper drums 18 and 19 from the supply conduits 36 and 39 and from the low pressure receiver 17 when the drums are subjected to high pressure. The drums 18 and 19 are each provided with discharge conduits 43 and 44 which, by virtue of the check valves 45 and 46, are effectively isolated, one from the other, while both are coupled to the delivery conduit 48 supplying chilled refrigerant to the rink zone.

Conduit 48 is coupled to one end of the high pressure header or trunk distribution head 50 as shown, with conduit 49 being coupled to the opposite of high pressure head 50. A balance header 51 is utilized to couple opposed ends of high pressure header 50 together, and an intermediate conduit line 52 is provided to couple the central or mid-portions 53 and 54 of the balance header 51 and high pressure header 50 respectively together. High pressure header 50 is provided with a plurality of distribution lines such as, for example, the distribution lines 56–56. A low pressure header or refrigerant collecting header 57 is utilized to collect the refrigerant from lines 56–56 and deliver it into line 58 for ultimate return to the low presure receiver 17. Service valve 59 may be employed along line 58 as required.

In order to provide the force necessary to transmit the refrigerant from the drums through line 48 and retain this refrigerant in liquid phase, attention is directed to the output 27 of the liquid storage vessel 16. Line 27 couples liquid storage vessel 16 to a juncture point 65, solenoid valve 66 and check valve 67 being interposed along line 27 between the liquid storage vessel 16 and the juncture point 65. Line 68 connects the juncture point 65 to the inlet of the pumper drum 18. A parallel system for providing high pressure to the pumper drum 19, this including conduit 69 which extends between the line 27 and a juncture point 70. A solenoid valve 71 and check valve 72 are interposed along line 69 for control. Conduit 78 has a segment coupling juncture point 70 to the inlet of drum 19.

Juncture point 65 is coupled also to a conduit or line 74 which conduit is, in turn, coupled to the low pressure receiver 17, through check valve 75 and solenoid valve 76 for the purpose of venting drum 18. Similarly, an upper segment of line 78 extends from juncture point 70 to the low pressure receiver 17, this upper segment of line 78 including check valve 79 and solenoid valve 80.

As previously indicated, drums 18 and 19 are filled by gravity through lines 36 in the case of pumper drum 18 and a combination of lines 36 and 39 in the case of pumper drum 19. In order to accommodate this gravity fill, and with specific reference to pumper drum 18, conduit 58 functions as a vent during the filling operation, and with solenoid valve 56 in a closed position and solenoid valve 76 in an open position, refrigerant in gaseous phase moves from pumper drum 18 along line 68 to juncture point 56, and thereafter from juncture 65 to the low pressure receiver 17 by way of line 74. In a similar fashion, pumper drum 19 is vented to low pressure receiver 17. When either drum is filled to an upper level as sensed by a float or fluid level sensor 82, the disposition of solenoid valve 66 and 76 is reversed, and the high pressure fluid from the liquid storage vessel 16 is transmitted directly into the drum 18 by way of line 27 from liquid storage vessel 16 to juncture point 65, and then through line 68 to drum 18. This operation is continued until the level in drum 18 is reduced to the lower level or point indicated by liquid level sensor 83. During the discharge of refrigerant from storage vessel 16 to pumper drum 18, a portion of the fluid in vessel 16 may be transformed to the gaseous phase. When the lower level point is reached in drum 18, the disposition of the solenoid valves 66 and 76 is again reversed, and pumper drum 18 resumes its filling cycle. In a similar fashion, pumper drum 19 is filled and emptied, and the two pumper drums operate independently in order to provide a maximum flow of chilled refrigerant in liquid phase to the high pressure header 50 by way of delivery conduits or lines 48 and 49. The check valves 45 and 46 provide for unidirectional flow of fluid from lines 48 and 49 through the high pressure header 50 and the individual lines 56–56. In the event a problem arises in connection with either of the pumper drums 18 or 19, then, and in that event, the system may accommodate the use of merely one pumper drum vessel to achieve operation of the system.

Figure 2:
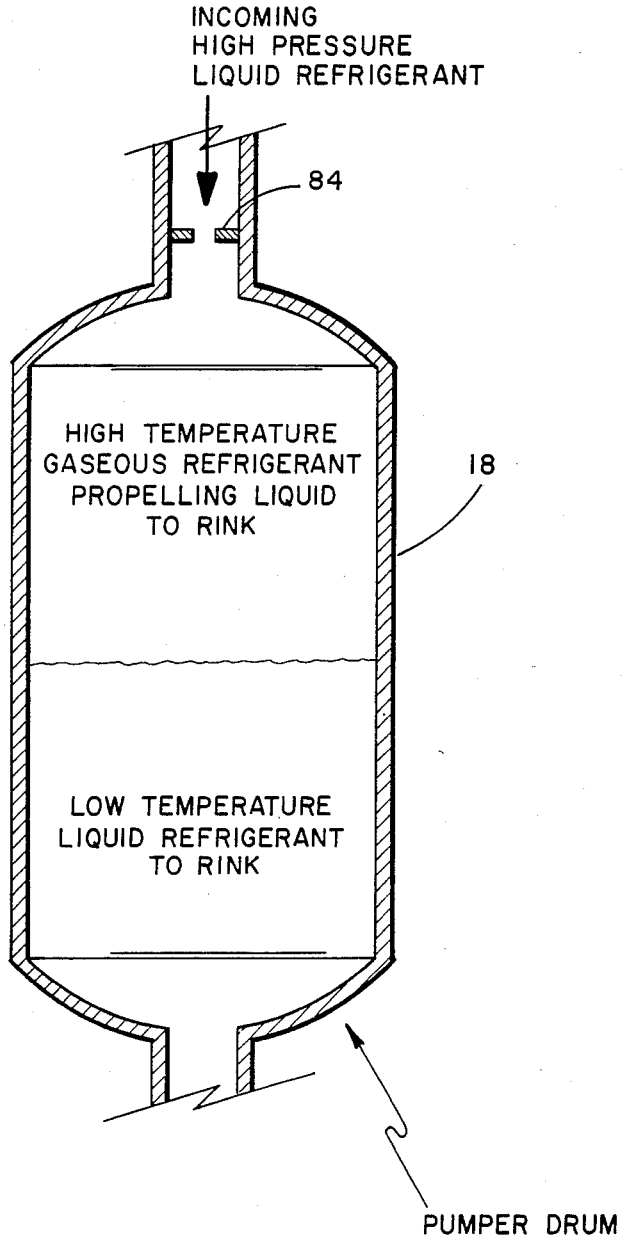
FIG. 2 is a fragmentary vertical sectional view, on a substantially enlarged scale, and illustrating the zone in which the fixed orifice of the system of the present invention is disposed adjacent the pumper drum.

As is shown in both FIGS. 1 and 2, orifices 84 and 84A are interposed along lines 68 and 78 respectively, and positioned at a point immediately adjacent the upper portion of pumper drums 18 and 19 respectively. For those systems employing a pumper drum with a volume of 39.66 gallons, and having high pressure-high temperature refrigerant delivered thereto at a pressure of approximately 140 to 200 psi (105° F.), an orifice diameter of approximately 5/32" has been found most suitable. Such a system is typically used with 75 or 100 horsepower compressors and with a total refrigeration capability per system of approximately 1,200,000 to 1,620,000 btu. In the system described, a pair of pumper drums will be utilized.

Since most fluorinated hydrocarbons such as constitute Freon-22 are completely miscible or compatible with the oils utilized to lubricate the compressors, it is frequently desirable to provide a bleed line to continuously separate the oil from the refrigerant. Thus, the bleed line 85 is provided between the low pressure receiver 17 and a refrigerant-oil separator 86. The separator is provided with a discharge line 87 to carry the separated oil back to an oil receiver 88, and ultimately into the compressors 11 and 12, respectively, as shown. Line 89 and its check valve 90 are utilized to permit transfer of the liquid refrigerant from the separator 76 to the line 48.

Pressure gauge and thermometer indicators are frequently desirable, these being shown for example, along delivery conduit 48 as at 81. It will be appreciated that instrumentation is not essential to the operation of a calibrated system, however for purposes of uniform operation, such instrumentation is normally desired.

While the system has been illustrated with the headers 52 and 57 being disposed on opposite ends of the rink, it will be appreciated that the system can be utilized with these headers disposed on opposite sides of the rink as well. The chilled refrigerant which is driven through the distribution system is maintained substantially in the liquid state during its transfer therethrough. There is, of course, a certain transformation from liquid to gaseous phase, however, since the refrigerant is exposed to a modest increase in pressure during its movement through the distribution lines, the degree of transformation from liquid to gaseous phase is minimal. Thus, refrigerant entering the distribution head at 15°–18° F. will normally leave this distribution head at a temperature of no less than about 12° F. The utilization of the fixed orifice provides a fine degree of control for the temperature of the refrigerant leaving the pumper drums and entering the distribution head.

The efficiency of this system is also significantly high. Since the degree of efficiency of a compressor device is related at least in part to the temperature differential existing across the compressor, that is, from inlet to outlet, the present system is one capable of high efficiency since the temperature differential is maintained at a substantially minimal value.

I claim:

1. In a refrigeration system for delivering chilled refrigerant substantially entirely in the liquid state to a zone where heat is being extracted and including compressor means having an inlet and an outlet for delivering high pressure refrigerant therefrom, means for delivering said high pressure refrigerant to a first storage vessel wherein said output is received and at least partially evaporated and maintained at a relatively lower pressure, means for intermittently delivering refrigerant in liquid phase from said first storage vessel to a second storage vessel wherein said delivered refrigerant is received and normally maintained at said relatively lower pressure, first conduit means for providing communication between the upper portions of said first and said second storage vessels, means including said first conduit means for intermittently coupling said second storage vessel substantially directly to said high pressure refrigerant, means for delivering the refrigerant from said second storage vessel under the influence of said high pressure refrigerant to the zone where heat is being extracted, and means for returning the refrigerant from said zone where heat is being extracted to said first storage vessel, the improvement comprising:

(a) fixed orifice means disposed within said first conduit means immediately adjacent the inlet to said second storage vessel and adapted to provide an expansion zone within said second storage vessel to achieve pressure reduction for high pressure refrigerant flowing therealong from said compressor means to said second storage vessel.

2. The refrigeration system as defined in claim 1 being particularly characterized in that a plurality of said second storage vessels are provided for alternate coupling to said first storage vessel and to said compressor outlet.

3. The refrigeration system as defined in claim 1 being particularly characterized in that the zone where heat is being extracted is a skating rink.

* * * * *